US008456093B2

(12) United States Patent
Väänänen et al.

(10) Patent No.: US 8,456,093 B2
(45) Date of Patent: Jun. 4, 2013

(54) APPARATUS AND METHOD FOR LED ARRAY CONTROL

(75) Inventors: Ari Kalevi Väänänen, Oulu (FI); Jussi Petteri Tikkanen, Haukipudas (FI); Vladimir Trondin, Oulu (FI)

(73) Assignee: Texas Instruments Incorporated, Dallas, TX (US)

( * ) Notice: Subject to any disclaimer, the term of this patent is extended or adjusted under 35 U.S.C. 154(b) by 253 days.

(21) Appl. No.: 13/072,183

(22) Filed: Mar. 25, 2011

(65) Prior Publication Data

US 2012/0242236 A1 Sep. 27, 2012

(51) Int. Cl.
*H05B 37/02* (2006.01)

(52) U.S. Cl.
USPC ..... 315/192; 315/297; 345/102

(58) Field of Classification Search
USPC ..... 315/192, 294, 297, 307; 345/87, 345/102
See application file for complete search history.

(56) References Cited

U.S. PATENT DOCUMENTS 8,330,393 B2 * 12/2012 Thomson et al. ..... 315/308
2003/0058210 A1 3/2003 Yamazaki et al.
2006/0022898 A1 2/2006 Chen
2007/0182699 A1 8/2007 Ha et al.
2011/0074839 A1 * 3/2011 Liu et al. ..... 345/690
2011/0164069 A1 * 7/2011 Thompson et al. ..... 345/690
2011/0260643 A1 * 10/2011 Huang et al. ..... 315/294

FOREIGN PATENT DOCUMENTS

KR 100946093 B1 3/2010
KR 100965780 B1 7/2010

* cited by examiner

*Primary Examiner* — Don Le
(74) *Attorney, Agent, or Firm* — Andrew S. Viger; Wade J. Brady, III; Frederick J. Telecky, Jr.

(57) ABSTRACT

A control module for driving an LED array, with the array including N number of LED current drivers connected to N number of electrical terminals of the module, and Y number of transistor switches connected between Y number of electrical terminals of the module and a common voltage point. N and Y are each at least three. An N number of column conductors and a Y number of row conductors are to be connected to the respective N and Y number of electrical terminals. At least one of the N×Y number of LEDs is connected between each pair of the column and row conductors. The control module further includes a controller for controlling the states of the N number of LED current drivers and the Y number of transistor switches so that, during a given LED drive period, all of the LED current drivers are activated and only one of the transistor switches is turned ON to provided a selected row conductor in which case only those LEDs connected to a selected row conductor are activated.

26 Claims, 5 Drawing Sheets

APPARATUS AND METHOD FOR LED ARRAY CONTROL

BACKGROUND OF THE INVENTION

1. Field of the Invention

The present invention relates generally to electronic displays and in particular to LED control circuitry for back lighting LCD displays and the like.

2. Description of Related Art

Liquid crystal displays (LCD) are common type of electronic display. FIG. 1 shows a conventional LCD display which includes an LCD panel 20 which produces various pixels to define an image. A back light unit 24 operates to provide light to the LCD panel, with a light conductor plate 22 being disposed between the LCD panel and the back light unit 24. The back light unit 24 uses LEDs that provides improved power consumption, brightness and weight as compared to other back lighting devices such as cold cathode fluorescent lamps. In order to provide a color display, the LED backlighting unit may include a combination of red, green and blue (RGB) LEDs that are driven using what is termed the field sequential color (FSC) driving method. This method displays a color by relying upon the after image effect in human vision. As can be seen in the timing diagram of FIG. 2, one frame of image (or picture frame) divided into three sub-pictures (subframes). At the beginning of a typical picture frame, there is a Red sub-picture, followed by a Green sub-picture which is then followed by a Blue sub-picture. At the beginning of the Red sub-picture, the LCD panel 20 is refreshed and the Red LEDs in backlight unit 24 are driven. Thus, during the Red sub-picture, the Red components of the image is displayed. The same sequence is carried out during the subsequent Green and Blue sub-pictures. The separate color sub-pictures are not detected by the human eye, with the result being a full color image generally free of flicker.

Note that the LED backlight panel 24 of FIG. 1 is suited for relatively large LCD displays. For smaller displays, the backlighting LEDs are disposed on the edges of the LCD panel 20 so that the overall thickness of the display is substantially reduced. A light guide (not depicted) is than used diffused the light over the panel equally.

The circuitry for driving the LED backlight unit 24 using the FSC driving method is typically located in a circuit module separate from the unit itself. A typical circuit module may be in the form of an integrated circuit disposed in a integrated circuit package, with that package having a limited number of pins (electrical terminals) for interfacing with the LED unit 24 and other external circuit components.

There is a need for a circuit module for driving a LED backlight panel using the FSC driving method and other methods that requires only a limited number of pins but yet is capable of providing an optimized drive to the individual LEDs of the panel. As will become apparent to those skilled in the art after a reading of the following Detailed Description of the Invention together with the drawings, the present invention addresses these and other shortcomings of prior art LED driver circuits.

DETAILED DESCRIPTION OF THE INVENTION

Figure 3:
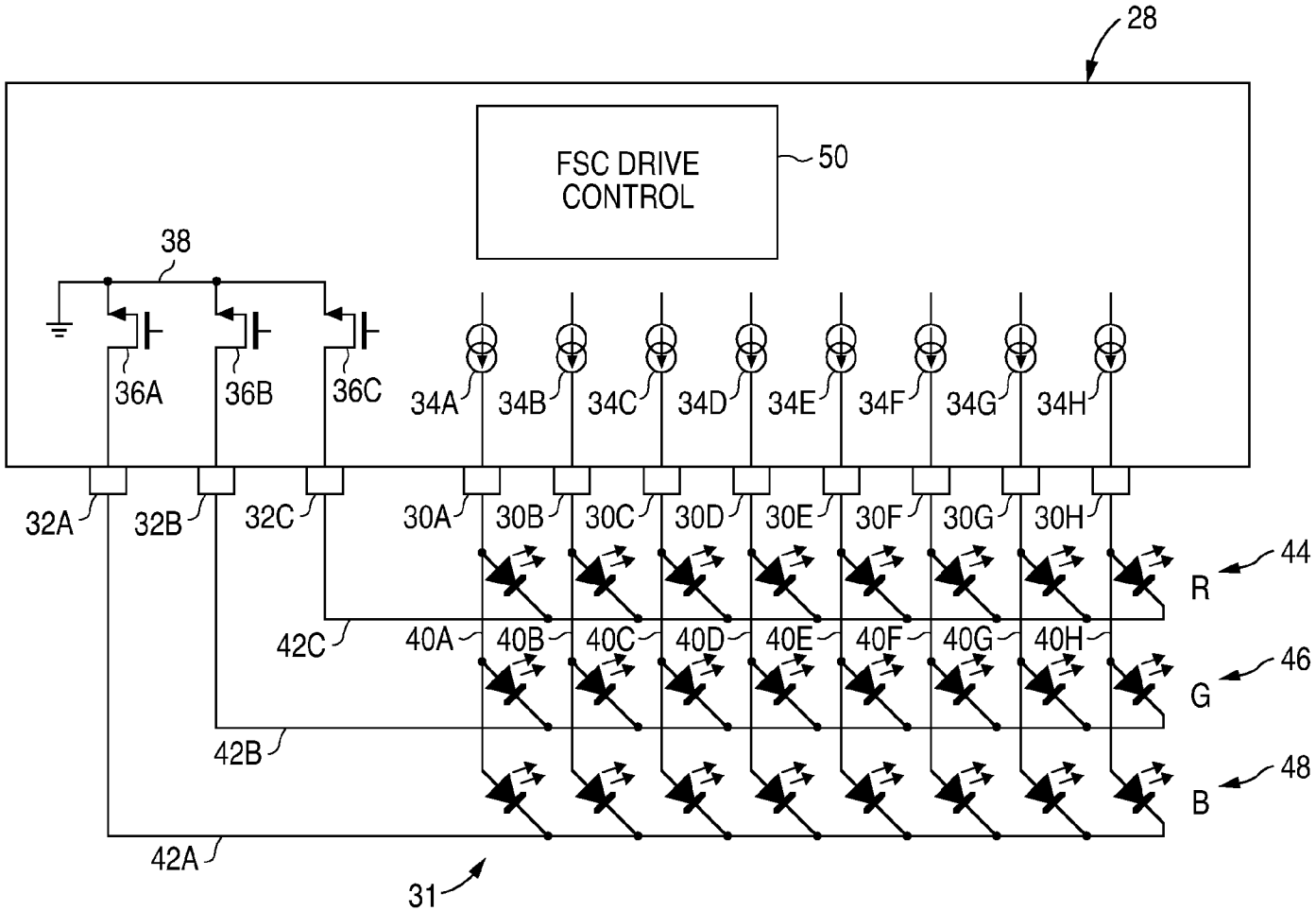
FIG. 3 shows an LED control module in accordance with one embodiment of the present invention connected to an LED matrix.

Referring again to the drawings, FIG. 3 shows one embodiment of the present invention. A control module 28 is disclosed for driving an LED matrix array. The control module is typically implemented in the form of an integrated circuit enclose by a circuit package that contains the electrical terminals such as pins for interfacing with the external components. The circuit package may also be a surface mounted device (SMD) which utilizes contact bumps which function as the electrical terminals of the device. The LEDs of the array are arranged in rows and columns, with the array being preferably configured for Field Sequential Color driving. The array includes a first row 44 of eight Red LEDs, a second row 46 of Green LEDs and third row 48 of Blue LEDs. The cathodes of the LEDs in row 48 are all connected to a first row conductor line 42A which is to be connected to a pin (electrical terminal) 32A of the control module 28. The cathodes of the LEDs in row 46 are all connected to a second row conductor line 42B which is to be connected to a pin 32B of the control module, with the cathodes of the LEDs in row 44 are all connected to a third row conductor line 42C which is to be connected to pin 32C of the control module 28.

Each of the eight columns of LEDs has an associated column conductor line 40A-40H, with each of the column conductor lines to be connected to respective control module pins 30A-30H. The anodes of the LEDs in a particular column are connected to the column conductor line associated with that column. By way of example, the anodes of the Red, Green and Blue LEDs on one column are connected to the column conductor line 40A associated with that column.

The control module 28 includes three transistor switches 36A, 36B and 36C having respective switch terminals connected to separate ones of the control module pins 32A, 32B and 32C (the row driver pins). The opposite switch terminals of the transistor switches are connected in common to the circuit ground of the control module. As will be described, the states of switches 36A, 36B and 36C are independently controlled by an FSC Drive Control 50 of module 28. Each of the column driver pins 30A-30H has an associated LED driver 34A-34H disposed within control module 28, with the LED drivers each being independently controlled by the FSC Drive Control 50 (the control lines are not depicted). Note that the details for implementing Control 50 are conventional and would be readily apparent to those skilled in the art upon reading the present disclosure. Thus, in order to avoid obscuring the true nature of the present invention in unnecessary detail, such details are not presented here.

Figure 1:
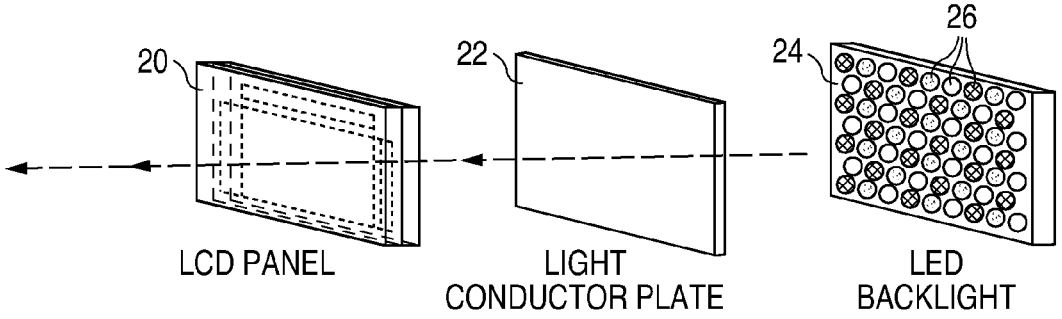
FIG. 1 (PRIOR ART)
FIG. 1 depicts a prior art LCD color display which includes and LED back light unit utilizing Red, Green and Blue LEDs.
Figure 2:
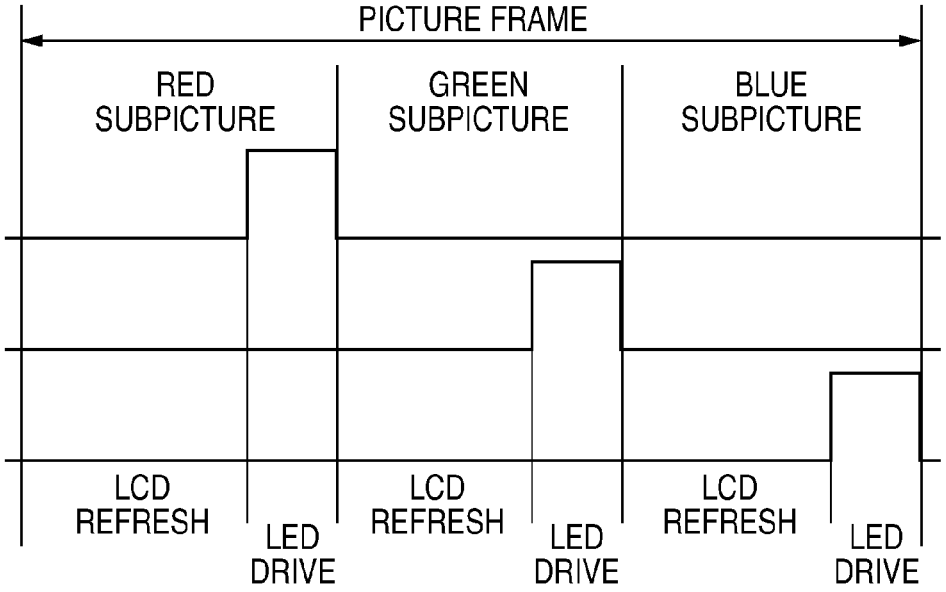
FIG. 2 (PRIOR ART)
FIG. 2 is a timing diagram illustrating the field sequential color (FSC) driving method in accordance with the prior art.

The FSC Driver Control 50 operates in synchronization with the controller (not depicted) for controlling the LCD. Referring to both the timing diagram of FIG. 2 and the FIG. 3 LED array and control module, a typical picture frame begins by refreshing the LCD for the Red sub-picture image. After the refresh, the eight Red LCDs of the array are driven (activated). In order to carry out this action, the FSC Drive Control 50 will switch transistor 36C to an ON state, with the other switches 36B and 36C remaining OFF. Thus, row conductor line 42C is grounded, with lines 42B and 42C remaining open circuited. The FSC Drive Control 50 will further actuate each of the LED drivers 34A-34H, with the drive current being selected for driving the Red LEDS, since the cathodes of the Green and Blue LEDs are unconnected to ground. At the end of the Red sub-picture, Control 50 turns the eight LED drivers off so that the Red LEDs are deactivated. In addition, Control 50 turns transistor 36C OFF. Following the end of the Red sub-picture, the LCD is refreshed for the Green sub-picture. Next, the Green LEDs 46 are driven when Control 50 turns transistor switch 36B ON and enables LED drivers 34A-34H. Once again, the drive current can be optimized by Control 50 for driving Green LEDs. At the end of the Green sub-picture, the Green LEDs are deactivated, with the sequence being repeated for the Blue sub-picture when Blue LEDs 48 are activated.

The LED drivers 34A-34H are preferably implemented to provide drive currents with controlled precision, with 12 bit current resolution being preferred. Thus, the FSC Drive Control 50 can independently control each of the drivers thereby providing the capability of matching the drive characteristics to the individual LEDs. As previously noted, the optimum drive currents for differing color LEDs are different, with Control 50 being able to make the appropriate adjustments depending upon the color of the sub-picture. In addition, the drivers can be configured to provide a feedback signal to Control 50 regarding the state of each LED so that the drive to the individual LEDs in a given row can also be optimized by Control 50.

Figure 4:
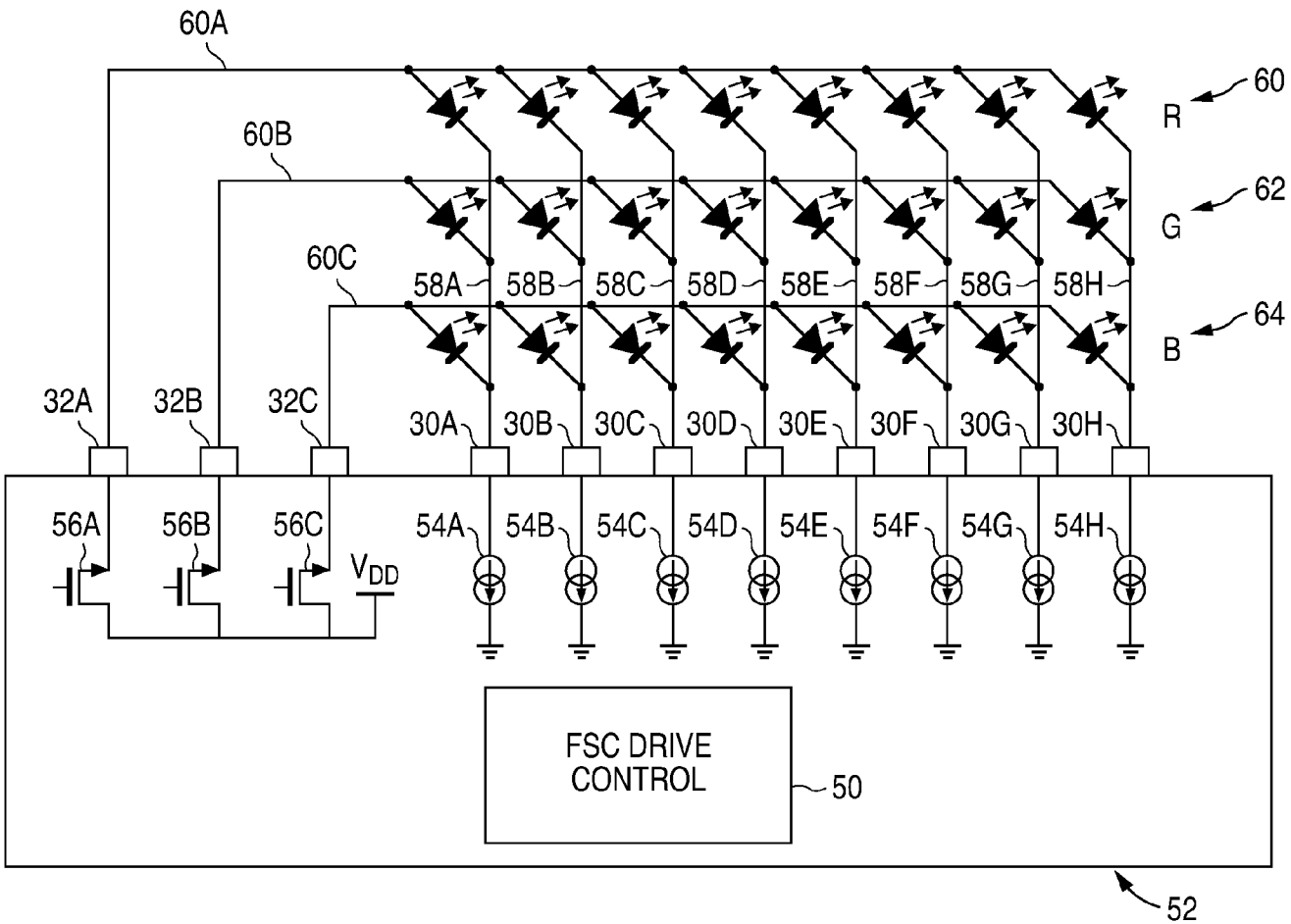
FIG. 4 shows an LED control module in accordance with another embodiment of the present invention connected to an LED matrix.

FIG. 4 shows another embodiment 52 of the subject control module. In this case, the LEDs are arranged in the matrix so that the cathodes are connected to the associated column conductor lines 58A-58H and the anodes are connected to the associated row conductor lines 60A-60C. Eight LED drivers are included in the module 52 which are connected to the respective module pins 30A-30H. The LED drivers are configured to sink, rather than source, current present on the column conductor lines. Once again the states of the LED drivers are independently controlled by FSC Drive Control 50. Switching transistors 56A, 56B and 56C are provided having one set of terminals separately connected to the respective module pins 32A, 32B and 32C. The other set of the switch terminals connected are common to a positive voltage source Vdd. Switches 32A, 32B and 32C are separately controlled by FSC Control 50 so that a selected one of the three row conductor lines 60A, 60B and 60C can be connected to supply Vdd.

During a typical FSC drive sequence, the Red LED row 60 is activated during the Red sub-picture when Control 50 turns switch 56A on and further activates the eight LED drivers 54A-54H. Thus, drive current will flow from voltage source Vdd through ON switch 56A and through the eight Red LEDs into the LED drivers. Once again, it is preferred that the LED drivers 54A-54H have the same control features previously described in connection with drivers 34A-34H of the first embodiment of FIG. 3.

Figure 5A:
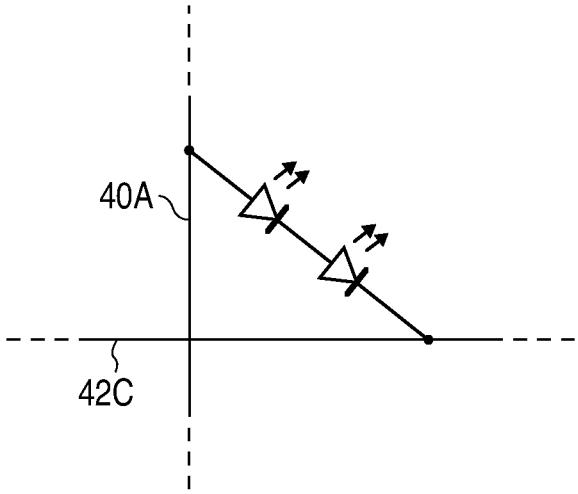
FIGS. 5A and 5B show a modification of the LED arrays of FIGS. 3 and 4 where multiple LEDs, as opposed to a single LED, are disposed between selected row and conductor lines.
Figure 5B:
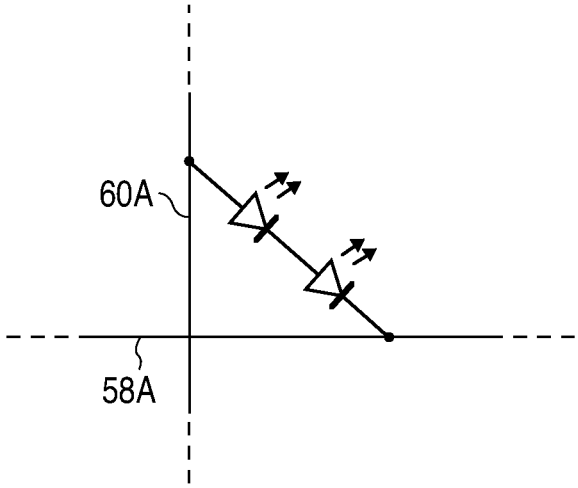

The previously described LED matrices described in connection with FIGS. 3 and 4 utilize a single LED for each N×Y column/row location. It would be possible to replace the single LEDs of these matrices with two or more LEDs, usually of the same color. By way of example, FIG. 5A show a pair of LEDs connected between column conductor line 40A and row conductor line 42C of FIG. 3. As a further example, FIG. 5B shows a pair of LEDs connected between row conductor line 60A and column conductor line 58A. In order to accommodate the driving of multiple LEDs at the same time by a single driver, it will be necessary to adjust the drive voltage level including voltage Vdd of FIG. 4 but also the LED driver 54A-54H and 34A-34H characteristics.

Figure 6:
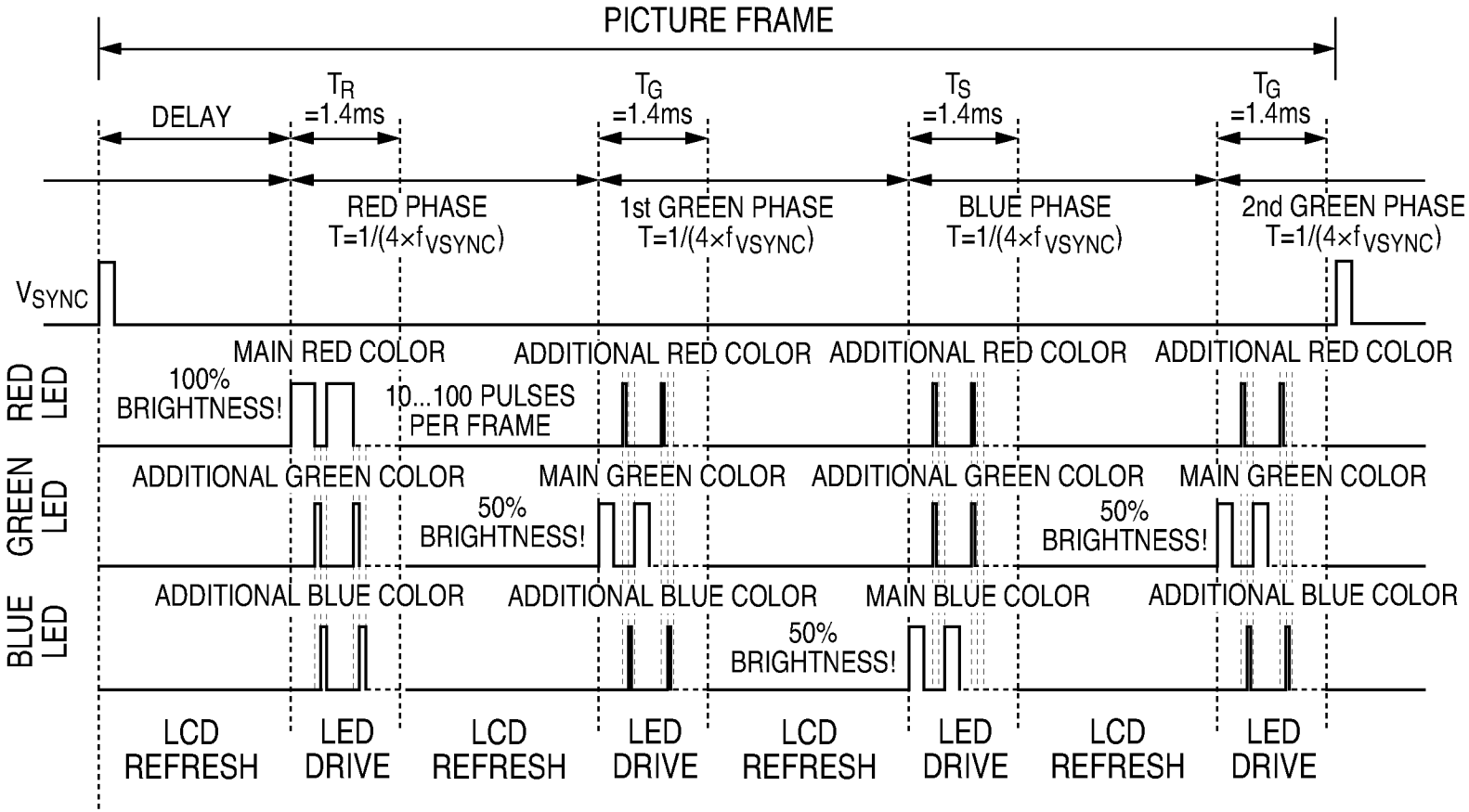
FIG. 6 is a timing diagram of an alternative FSC driving method.

FIG. 6 is a timing diagram of an alternative FSC driving method. In this case, a picture frame is divided into four sub-frames rather than three. During first, second and third sub-frames, the respective Red, Green and Blue LEDs predominate, with Blue LEDs period being repeated in the fourth sub-frame. Since only a single color LED is driven at any one time, each of the sub-frame includes a a sequence of Red, Green and Blue drive period, with the drive periods being interleaved. Thus, as can be seen from the FIG. 6 diagram, the three sets of color LEDs are time multiplexed during a given sub-frame. During the sub-frame, the Red LEDs of row 44 of FIG. 3 are turned ON for a first duration following by the Green LEDs of row 46 followed by the Blue LEDs of row 48, with this interleaving of colors taking place throughout the remainder of the sub-frame. The contribution of the three LED colors during a given sub-frame is determined by the relative total times that a given color LED is turned ON and by the brightness of each color. During the first sub-frame, the color Red predominates. During second sub-frame, the color Green predominates, with the color Blue predominating in the sub-frame. During the fourth sub-frame the color Blue again predominates. When a color predominates in a sub-frame, the total duration that the predominating color LED is driven exceeds the total duration that any one of the other colors LEDs is driven during that sub-frame.

Thus, a novel control module for driving an LED array has been disclosed. Although two embodiments have been described in some detail, it is to be understood that certain changes can be made by those skilled in the art without departing from the spirit and scope of the invention as defined by the appended claims.

What is claimed is:

1. A control module for driving a light emitting diode (LED) array, said control module including a plurality of electrical terminals for providing electrical connections between components internal to the control module and components external to the control module, with the LED array including at least N number of column conductors disposed external to the control module which are to be separately connected to N number of the electrical terminals and including at least Y number of row conductors disposed external to the control module which are to be separately connected to N number of the electrical terminals and further including at least N×Y number of LEDs disposed external to the control module, with at least one LED being connected between a separate pair of the column and row conductors, where N and Y are at least three, said control module further including the following disposed internal to the control module:

N number of LED current drivers having outputs electrically connected to separate ones of the N number of electrical terminals;

Y number of transistor switches, each of the transistor switches having a first set of switch terminals separately connected to separate ones of the Y number of electrical terminals and each having a second set of switch terminals electrically connected to a common voltage point; and a controller for controlling the states of the N number of LED current drivers and the Y number of transistor switches during each of a consecutive number of separate LED drive periods, wherein during a given one of LED drive periods, all of the N number of LED current drivers are activated and only one of the transistor switches is turned ON so that only the N number of LEDs connected to the row conductor associated with the ON transistor switch are driven.

2. The control module of claim 1 wherein the N number of LED current drivers are configured to source current towards the associated electrical terminal so that when the LEDs are arranged in the array so that LED anodes are connected to the associated column conductor so that the LEDs can conduct the sourced current.

3. The control module of claim 2 where the common voltage point is ground potential.

4. The control module of claim 1 wherein the N number of LED current drivers are configured to sink current away from the associated electrical terminal so that when the LEDs are arranged in the array so that the LED anodes are connected to the associated row conductor so that the LEDs can conduct the sunk current.

5. The control module of claim 1 wherein the common voltage point is a positive voltage.

6. The control module of claim 1 the N number of LED current drivers each include adjustable current level outputs and wherein the controller is capable of separately controlling each of the current driver current level outputs.

7. The control module of claim 1 wherein images are produced during a series of consecutive picture frames, with each picture frame being subdivided into at least three sub-frames, with each sub-frame including at least one of the LED drive periods.

8. The control module of claim 7 wherein each sub-frame includes a first drive period where the LEDs connected in a first one of the row conductors is driven, followed by a second drive period where the LEDs connected to a second one of the row conductors is driven followed by a third drive period where the LEDs connected to a third one of the row conductors is driven.

9. The control module of claim 8 where each picture frame is subdivided into at least four sub-frames, with each sub-frame including a first drive period where the LEDs connected in a first one of the row conductors is driven, followed by a second drive period where the LEDs connected to a second one of the row conductors is driven followed by a third drive period where the LEDs connected to a third one of the row conductors is driven.

10. A lighting assembly comprising:

a light emitting diode (LED) array including,

N number of column conductors where N is at least three,

Y number of row conductors where Y is at least three, and at least N×Y number of LEDs, with at least one LED is connected between a separate pair of the column and row conductors and with LEDs solely of a first color being connected to a first one of the row conductors, with LEDs solely of a second color being connected to a second one of the row conductor and with LEDs solely of a third color being connected to a third one of the row conductors and wherein the first, second and third colors are differing colors; and a control module including, a plurality of electrical terminals for providing electrical connections between components within the control module and components outside the control module, with components outside the control module including the LED array, with N number of the electrical terminals connected to separate ones of the column conductors and with Y number of the electrical terminals connected to separate ones of the row conductors;

N number of LED current drivers internal to the control module and having outputs electrically connected to separate ones of the N number of electrical terminals;

Y number of transistor switches internal to the control module, with each of the transistor switches having a first set of terminals separately connected to separate ones of the Y number of electrical terminals and each the transistor switches having a second set of terminals electrically connected to a common voltage point; and a controller internal to the control module and configured for controlling the states of the N number of LED current drivers and the Y number of transistor switches.

11. The lighting assembly of claim 10 wherein the controller is further configured so that during a given one of a consecutive number of separate LED drive periods, all of the N number of LED current drivers are activated and only one of the transistor switches is turned ON so that only the at least N number of LEDs connected to the row conductor associated with the ON transistor switch are driven.

12. The lightly assembly of claim 11 wherein a single LED is connected between the separate pair of column and row conductors.

13. The light assembly of claim 11 wherein at least two LEDs are connected in series between the separate pair of column and row conductors.

14. The light assembly of claim 10 wherein the N number of LED current drivers are configured to source current towards the associated electrical terminal so that when the LEDs are arranged in the array so that LED anodes are connected to the associated column conductor, the LEDs can conduct the sourced current.

15. The control module of claim 14 where the common voltage point is ground potential.

16. The control module of claim 10 wherein the N number of LED current drivers are configured to sink current away from the associated electrical terminal so that when the LEDs are arranged in the array with the LED anodes being connected to the associated row conductor so that the LEDs can conduct the sunk current.

17. The control module of claim 16 wherein the common voltage point is a positive voltage.

18. The control module of claim 10 the N number of LED current drivers each include adjustable current level outputs and wherein the controller is capable of separately controlling each of the current driver current level outputs.

19. The control module of claim 10 wherein images are produced during a series of consecutive picture frames, with each picture frame being subdivided into at least three sub-frames, with each sub-frame including at least one LED drive period during which at least some of the LEDs are driven.

20. The control module of claim 19 wherein each sub-frame includes first multiple LED drive periods where the LEDs solely of the first color are driven, second multiple LED drive periods where the LEDs solely of the second color are driven and a third multiple LED drive periods where the LEDs solely of the third color are driven.

21. The control module of claim 19 wherein during a first one of the sub-frames, a total duration of the first multiple LED drive periods exceeds a total duration of the second multiple LED drive periods and exceeds a total duration of the third multiple LED drive periods;

during a second one of the sub-frames, a total duration of the second multiple LED drive periods exceeds a total duration of the first multiple LED drive periods and exceeds a total duration of the third multiple LED drive periods; and during a first third one of the sub-frames, a total duration of the third multiple drive periods exceeds a total duration of the second multiple drive periods and exceeds a total duration of the third multiple driver periods.

22. The control module of claim 20 wherein during each of the first, second and third sub-fames, the first, second and third multiple LED drive periods are interleaved with one another.

23. A controller configured to control driving an array of LEDs of first, second and third differing colors over a series of consecutive picture frames, with each of the picture frames being divided into at least three sub-frames, wherein during each of the sub-frames, LEDs of the first, second and third color are driven at separate times and wherein, during a first one of the sub-frames, LEDs of the first color are driven for a total duration which exceeds a total duration that the LEDs of the second color are driven and which exceeds a total duration that the LEDs of the third color are driven;

during a second one of the sub-frames, LEDs of the second color are driven for a total duration which exceeds a total duration that the LEDs of the first color are driven and which exceeds a total duration that the LEDs of the third color are driven; and during a third one of the sub-frames, LEDs of the third color are driven for a total duration which exceeds a total duration that the LEDs of the first color are driven and which exceeds a total duration that the LEDs of the second color are driven.

24. The controller of claim 23 wherein the first, second and third ones of the sub-frames occur are produced sequentially during each picture frame and wherein the first, second and third colors are red, green and blue, respectively.

25. The controller of claim 23 wherein each of the picture frames are divided into at least four sub-frames and wherein during a fourth one of the sub-frames, LEDs of the second color are driven for a total duration which exceeds a total duration that the LEDs of the first color are driven and which exceeds a total duration that the LEDs of the third color are driven.

26. The controller of claim 25 wherein the first, second, third and fourth ones of the sub-frames occur are produced sequentially during each picture frame and wherein the first, second and third colors are red, green and blue, respectively.

* * * * *